US005264146A

United States Patent [19]

Tobiason

[11] Patent Number: 5,264,146

[45] Date of Patent: Nov. 23, 1993

[54] COMPOUND AND METHOD FOR CLEANING DRAINS AND SEWER LINES

[75] Inventor: Timothy W. Tobiason, Silver Creek, Nebr.

[73] Assignee: Toby's Chemical Co., Silver Creek, Nebr.

[21] Appl. No.: 909,280

[22] Filed: Jul. 6, 1992

[51] Int. Cl.[5] ..... C11D 7/06; C11D 7/12

[52] U.S. Cl. ..... 252/157; 252/156; 252/158; 252/142; 252/143; 252/174.12; 252/174.14; 252/545; 252/DIG. 12

[58] Field of Search ..... 252/156, 158, 174.12, 252/174.14, 545, DIG. 12, 157, 142, 143

[56] References Cited

U.S. PATENT DOCUMENTS

| | | | |
|---|---|---|---|
| 3,506,582 | 4/1970 | Gertzman | 252/157 |
| 3,968,048 | 7/1976 | Bolan | 252/90 |
| 4,496,470 | 1/1985 | Kapiloff et al. | 252/181 |

*Primary Examiner*—Paul Lieberman
*Assistant Examiner*—David A. Zarneke
*Attorney, Agent, or Firm*—Henderson & Sturm

[57] ABSTRACT

The present invention includes a drain cleaning agent and a foaming agent. The foaming agent consists of a gas releasing compound and a surfactant or detergent. This mixture may be flushed into a drain or sewer line where it reacts with water to produce a large volume of foam which then will react with sewage deposits cause their breakdown and removal.

3 Claims, 2 Drawing Sheets

COMPOUND AND METHOD FOR CLEANING DRAINS AND SEWER LINES

TECHNICAL FIELD

The present invention is directed generally to an improved method of carrying drain and sewer line cleaning agents, and more particularly to a compound and method for carrying such agents to deposits which have accumulated within drain and sewer lines more effectively so that these deposits may be removed.

BACKGROUND ART

Drains and sewer lines have long been plagued with the problem of continued build-up of grease, sludge, organic wastes and other deposits which then interfere with the proper flow for which they were intended. The prior art teaches the use of various compounds for attacking these deposits, generally by flushing some cleaning agent through the lines or by using some sort of mechanical device which is drawn through the line and deposits the cleaning agent. The first of these teachings is quite ineffective because the agent will only reach that portion of the line which is in contact with the water which is carrying the agent. Thus, since the line is generally only partially filled with water, the upper portion of the line is untreated. The second of these teachings, while capable of reaching the upper portion of the line, is cumbersome, expensive, and very time consuming.

DISCLOSURE OF THE INVENTION

The compound and method of the present invention utilize a drain cleaning agent in conjunction with a foaming agent. The foaming agent consists of a gas releasing compound and a surfactant or detergent.

A party wishing to remove deposits of grease, sludge, organic or other matter may simply flush this compound down a toilet of his home or business. When the compound comes into contact with water, the gas releasing compound causes the surfactant or detergent to foam, and the foam then acts as a carrier of the cleaning agent throughout substantially the entire volume of the sewer line or drain.

BRIEF DESCRIPTION OF THE DRAWINGS

These and other attributes of the invention will become more clear upon a thorough study of the following description of the best mode of carrying out the invention, particularly when reviewed in conjunction with the drawings, wherein.

BEST MODE FOR CARRYING OUT THE INVENTION

Figure 1:
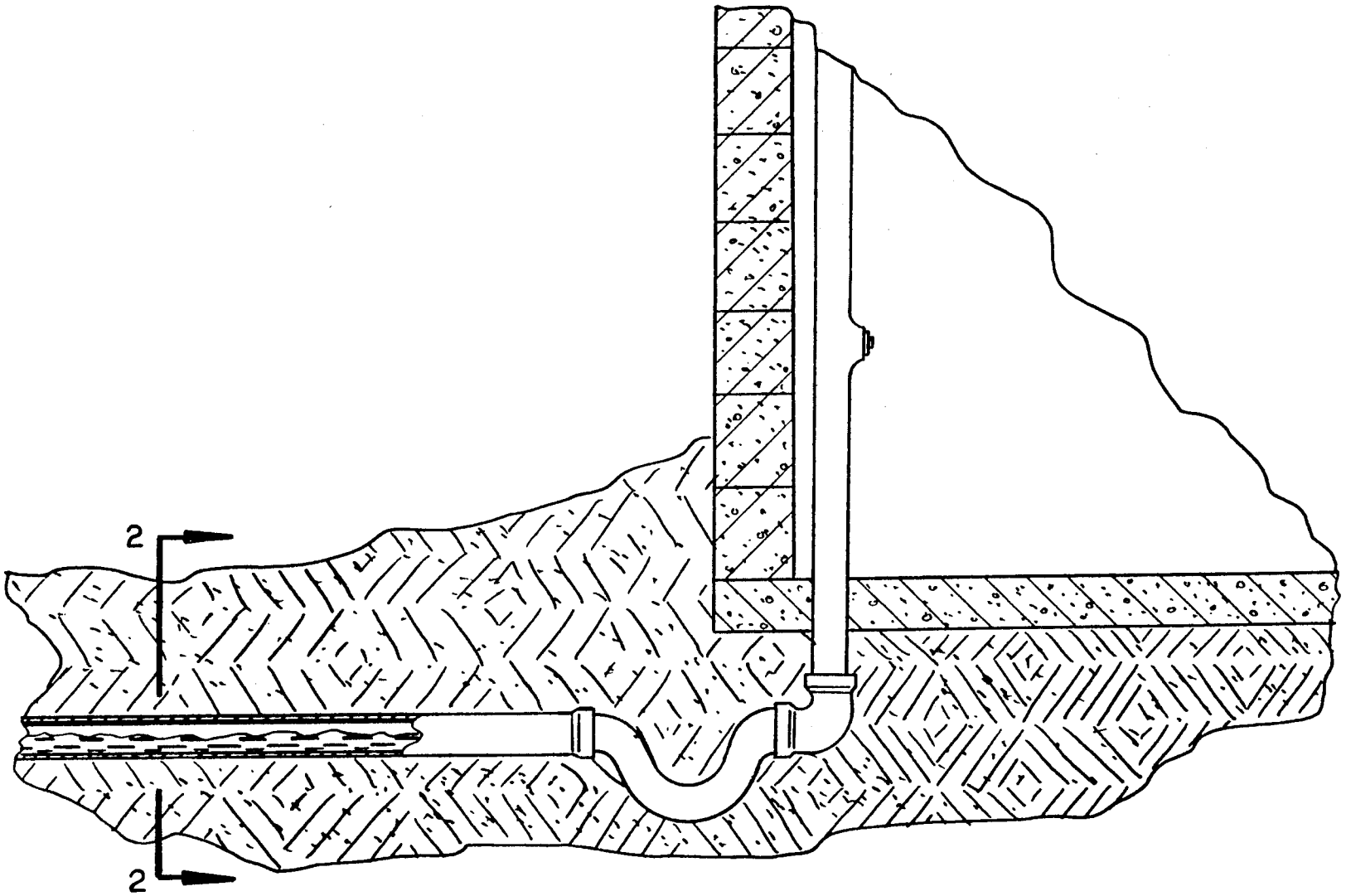
FIG. 1 depicts a conventional drain or sewer line.
Figure 4:
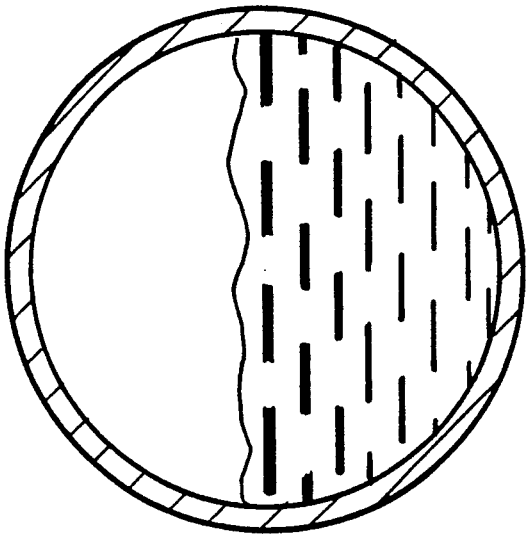
FIG. 4 is a cross-sectional view along line 2—2 of FIG. 1 showing the sewer line after cleaning with the present invention.
Figure 3:
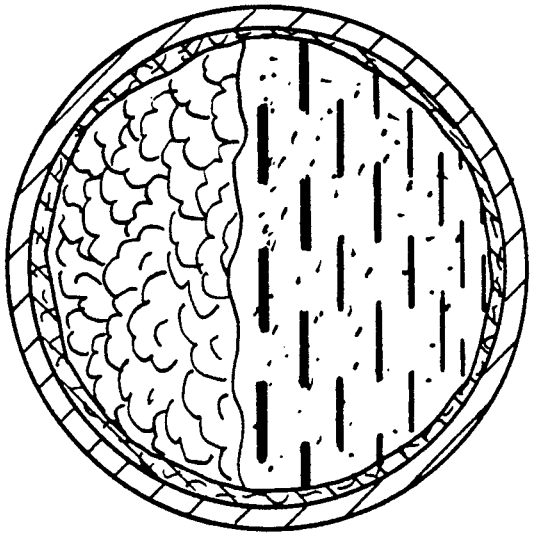
FIG. 3 is a cross-sectional view along line 2—2 of FIG. 1 showing the drain and sewer cleaner in use.
Figure 2:
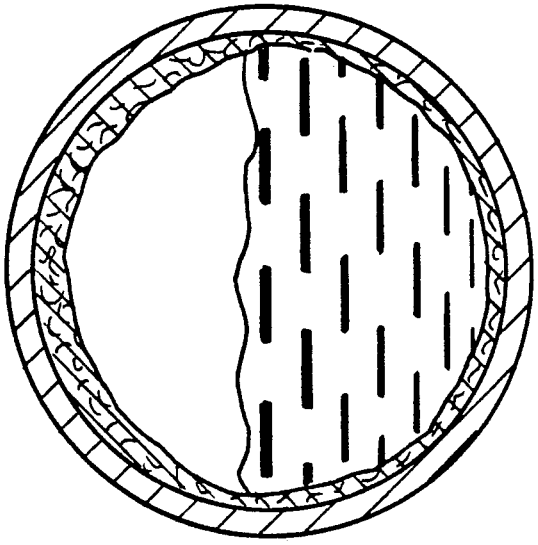
FIG. 2 is a cross-sectional view along line 2—2 of FIG. 1 showing a sewer line with a partial buildup of deposits.

The invention may utilize any of a number of drain cleaning agents that are capable of reacting with and breaking down deposits of grease, sludge, organic or other material which have accumulated within a drain or sewer line. These agents include, but are not restricted to, caustic soda, solvents, enzymes and bacteria. The particular agent to be selected would, of course, depend upon the use of the drainage system or sewer line to determine which of the agents would be most effective. Caustic soda has been found to be particularly effective. An effective solvent that may be used is orthodichlorobenzene. Many of the lipase class of enzymes have proven effective, as have lipase excreting bacteria. A commercially available product which contains both lipase and lipase excreting bacteria is "Lenzyme", available from Lenzyme Corporation.

The drain cleaning agent is then carried by a foaming agent consisting of a gas releasing compound and a surfactant or alkyl benzene sulfonate (ABS) detergent.

In order to generate a sufficient quantity of gas to cause the surfactant or detergent to foam, sulfamic acid ($H_2NSO_3H$) and sodium bicarbonate ($NaHCO_3$) may be used. Other compounds may also be reacted to produce a gas.

Although the proportions of the mixture are not critical and may be adjusted for the hardness of the water, the mixture of the preferred embodiment contains: (1) 10% cleaning agent selected from the group consisting of caustic soda, solvent, enzyme or bacteria, (2) 40% sulfamic acid, (3) 47% sodium bicarbonate, and (4) 3% octylphenoxyethanol.

It may therefore be seen that this compound may be flushed down a toilet or otherwise introduced into a drain or sewer line where it will come into contact with water. The ensuing chemical reaction creates a large volume of foam throughout the line by means of which is dispersed the drain cleaning agent. As the mass of foam is moved down the sewer line by the movement of the water, it will come into contact with deposits of sludge and grease or other organic deposits throughout the volume of the sewer line and may then begin a chemical breakdown of these deposits.

Obviously, many modifications and variations of the present invention are possible in light of the above teachings. It is therefore to be understood that, within the scope of the appended claims, the invention may be practiced otherwise than as specifically described.

I claim:

1. A method for removing grease, sludge, organic wastes and other deposits from drains and sewer lines, comprising flushing a drain or sewer line with a dry drain cleaning composition comprising:

(a) a drain cleaning agent wherein said agent is selected from the group consisting of caustic soda, enzymes and bacteria;

(b) a sulfamic acid;

(c) a carbonate; and (d) a surfactant, wherein said composition is mixed with water to produce foam, thereby removing deposits formed within a drain or sewer line.

2. A method as recited in claim 1 wherein said carbonate is an alkali carbonate.

3. A method as recited in claim 2 wherein said carbonate is an alkali bicarbonate.

* * * * *